US006385801B1

(12) United States Patent
Watanabe et al.

(10) Patent No.: US 6,385,801 B1
(45) Date of Patent: May 14, 2002

(54) ROCKING BED

(75) Inventors: Yasuo Watanabe; Kojiro Hamano, both of Shinjuku-ku (JP)

(73) Assignee: Kabushikikaisha Nihon M.D.M. (JP)

( * ) Notice: Subject to any disclaimer, the term of this patent is extended or adjusted under 35 U.S.C. 154(b) by 10 days.

(21) Appl. No.: 09/703,147

(22) Filed: Oct. 31, 2000

(30) Foreign Application Priority Data

Mar. 13, 2000 (JP) ..... 2000-069037

(51) Int. Cl.[7] ..... A61G 7/008
(52) U.S. Cl. ..... 5/607; 5/609
(58) Field of Search ..... 5/607, 609, 600, 5/109

(56) References Cited

U.S. PATENT DOCUMENTS 3,520,529 A * 7/1970 Obel ..... 5/607 X
3,748,666 A * 7/1973 Seng ..... 5/609
3,757,129 A * 9/1973 Hogan ..... 5/607 X
4,071,916 A * 2/1978 Nelson ..... 5/658
4,432,353 A * 2/1984 Vrzalik ..... 5/607 X
4,638,516 A * 1/1987 Vrzalik ..... 5/611
4,763,643 A * 8/1988 Vrzalik ..... 5/609 X
4,868,937 A * 9/1989 Connolly ..... 5/608
5,131,103 A * 7/1992 Thomas et al. ..... 5/601
6,263,526 B1 * 7/2001 Tu ..... 5/109

FOREIGN PATENT DOCUMENTS

DE 2932854 A * 2/1981 ..... 5/607

* cited by examiner

*Primary Examiner*—Robert G. Santos
(74) *Attorney, Agent, or Firm*—Adams & Wilks

(57) ABSTRACT

An arm 122 is secured on an upper end portion thereof to an output shaft 121 of a reduction gear 120 attached to a motor that is installed under a rest frame 115 on which a mattress is to be mounted. When rollers 123 provided on a lower end portion of the arm 122 are vertically guided along a vertical guide member 124 as the motor rotates forwardly and reversely, the arm 122 begins to swing right and left, thereby causing the rest frame 115 to rock quietly and gently about a rocking axis 115*a*. As a result of this construction, a rocking bed is provided, in which a motor is downsized and noise is reduced during the operation of a driving force transmission mechanism, and the rest frame for mounting a mattress rocks right and left properly with a simple construction.

6 Claims, 13 Drawing Sheets

ROCKING BED

BACKGROUND OF THE INVENTION

The present invention relates to a rocking bed which allows a rest frame (stretcher section) to rock right and left and, more particularly, to a rocking bed for medical use which is capable of rocking at large angles.

A conventional rocking bed, such as shown in FIG. 13, is of an all gear drive type, in which a rest frame 4 supported by struts 2 on a base frame 1 through a rocking shaft 3 can tilt up and down on either side when a worm 12 meshed with a worm wheel 11 that is integrated with the rocking shaft 3 rotates forwardly and reversely.

Further, a first rotating shaft 13 that is integrated with the worm 12 is driven to rotate by an electric motor 20A installed in a driving section 20. The driving force from the motor 20A is transmitted to the shaft 13 through a reducing and reversing mechanism 20B, an output shaft 20*a*, a gear coupling 21, a first transmission shaft 15, bevel gear shafts 16 and 18, a second rotating shaft 17, and spur gears 14 and 19.

In the above-mentioned rocking bed, the rest frame 4 is rocked by a transmission mechanism that is constructed solely of a gear transmission mechanism. This is advantageous in reducing the cost, but at the same time, it imposes problems that the gears make great noise during operation and that the size of the electric motor as a power source is increased and hence the total cost is elevated.

SUMMARY OF THE INVENTION

The present invention has been made to overcome these problems and an object thereof is, therefore, to provide a rocking bed in which a motor is downsized and noise is reduced during the operation of a driving force transmission mechanism, and in which a rest frame for mounting a mattress thereon can rock right and left properly with a simple construction.

To achieve the above object, one aspect of the present invention provides a rocking bed that comprises a base frame, struts respectively erected at both end portions of the base frame, a rest frame for mounting a mattress thereon, which is supported on upper end portions of the struts in a manner rockable right and left, and a driving mechanism for rocking the rest frame, wherein the driving mechanism comprises a motor installed under the rest frame, a reduction gear coupled to a rotating shaft of the motor, an output shaft projecting from the reduction gear in parallel with a rocking axis of the rest frame below the rocking axis, an arm having an upper end portion thereof secured to a distal end of the output shaft to be vertically suspended when the rest frame is in a horizontal position, a vertical guide member provided on the base frame for guiding only vertically a guided member on a lower end portion of the arm, and a motor control section for rotating the motor forwardly and reversely so that forward and reverse rotations of the output shaft allow the rest frame to rock right and left.

Another aspect of the present invention provides a rocking bed, wherein the guided member on the lower end portion of the arm is constructed of an independent roller rotatably supported on the lower end portion of the arm, and the vertical guide member is provided with a pair of guide surfaces for guiding the roller vertically, the guide surfaces closely flanking the roller on both sides of the roller.

Still another aspect of the present invention provides a rocking bed, wherein the guided member on the lower end portion of the arm comprises a roller support member rotatably supported on the lower end portion of the arm and a pair of rollers rotatably supported on the roller support member, and the vertical guide member is constructed as a vertically extending guide bar which is clamped between the pair of rollers.

Still another aspect of the present invention provides a rocking bed, wherein the motor control section comprises a selector switch for inverting the rotation of the motor when the rest frame reaches a preset maximum angle of inclination on the basis of a detected signal from an angle sensor for detecting an angle at which the rest frame is inclined.

Still another aspect of the present invention provides a rocking bed, wherein an inclination angle setting device for adjusting a maximum angle of inclination of the rest frame to a desired angle of inclination is connected to the motor control section.

Even another aspect of the present invention provides a rocking bed, wherein a motor rotating speed setting device for adjusting a cycle for rocking the rest frame right and left is connected to the motor control section.

In the above-mentioned rocking bed, as the output shaft of the reduction gear coupled to the rotating shaft of the motor rotates gently in the driving mechanism that is installed under the rest frame for mounting a mattress, the arm secured to the distal end of the output shaft on its upper end portion at right angles to the output shaft begins to turn, thereby causing the guided member on the lower end portion of the arm to receive a reaction force derived from its abutment with the vertical guide member, and this further causes the arm to gently swing sideward, hence allowing the rest frame to incline quietly while increasing its angle of inclination as the guided member rises along the vertical guide member.

Then, as the motor control section controls the motor to rotate forwardly and reversely, the rest frame begins to rock on either side properly.

Further, when the guided member on the lower end portion of the arm is constructed as the independent roller rotatably supported on the lower end portion of the arm and when the vertical guide member having the pair of guide surfaces closely flanking the roller on both sides of the roller is provided, the lower end portion of the arm can move up and down extremely smoothly, thereby allowing the rest frame for mounting a mattress thereon to rock right and left smoothly as well as quietly.

Still further, when the guided member on the lower end portion of the arm includes the roller support member rotatably supported on the lower end portion of the arm and the pair of rollers rotatably supported on the roller support member, and when the guide bar serving as the vertical guide member is clamped between these rollers, the lower end portion of the arm moves up and down extremely smoothly, and during such movement, the pair of rollers can move vertically while rotating in directions opposite to each other, so that they operate properly in touch with the guide bar without clearance at all times. Thus, the rest frame can rock right and left further smoothly and quietly.

Still further, when the control section of the motor includes the selector switch for inverting the rotation of the motor when the rest frame reaches a preset maximum angle of inclination based on a detected signal from the angle sensor for detecting the angle at which the rest frame is inclined, the forward and reverse driving of the motor can be controlled appropriately at all times and hence excessive inclination of the rest frame can be prevented.

Even further, when the inclination angle setting device, which applies an inclination angle setting signal for adjusting the maximum angle of inclination of the rest frame to a desired angle of inclination, is connected to the control section of the motor, the maximum angle of inclination of the rest frame can be set properly in accordance with the condition of a patient who is lying on the bed, and a maximum angle of inclination of about 60 degrees can even be set, if necessary, after checking that the patient is safely supported on the bed.

When the motor rotating speed setting device for adjusting the cycle of rocking the rest frame on either side is connected to the motor control section, the rocking cycle of the rest frame can be changed easily and smoothly, thereby permitting optimal adjustment of both the maximum angle of inclination of the rest frame and the position of a patient.

DETAILED DESCRIPTION

Figure 1:
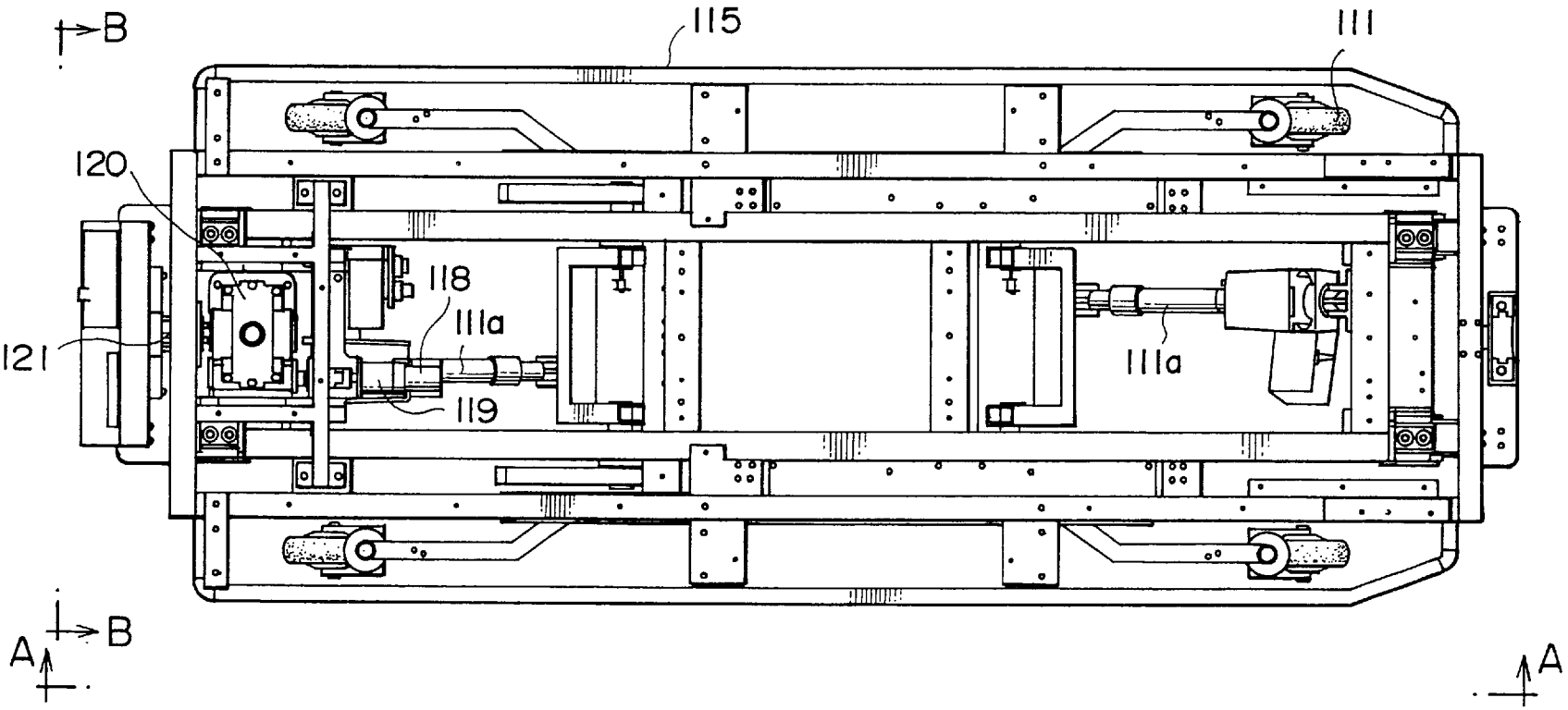
FIG. 1 is a plan view showing a rocking bed, which is an embodiment of the present invention, with a mattress removed therefrom.
Figure 2:
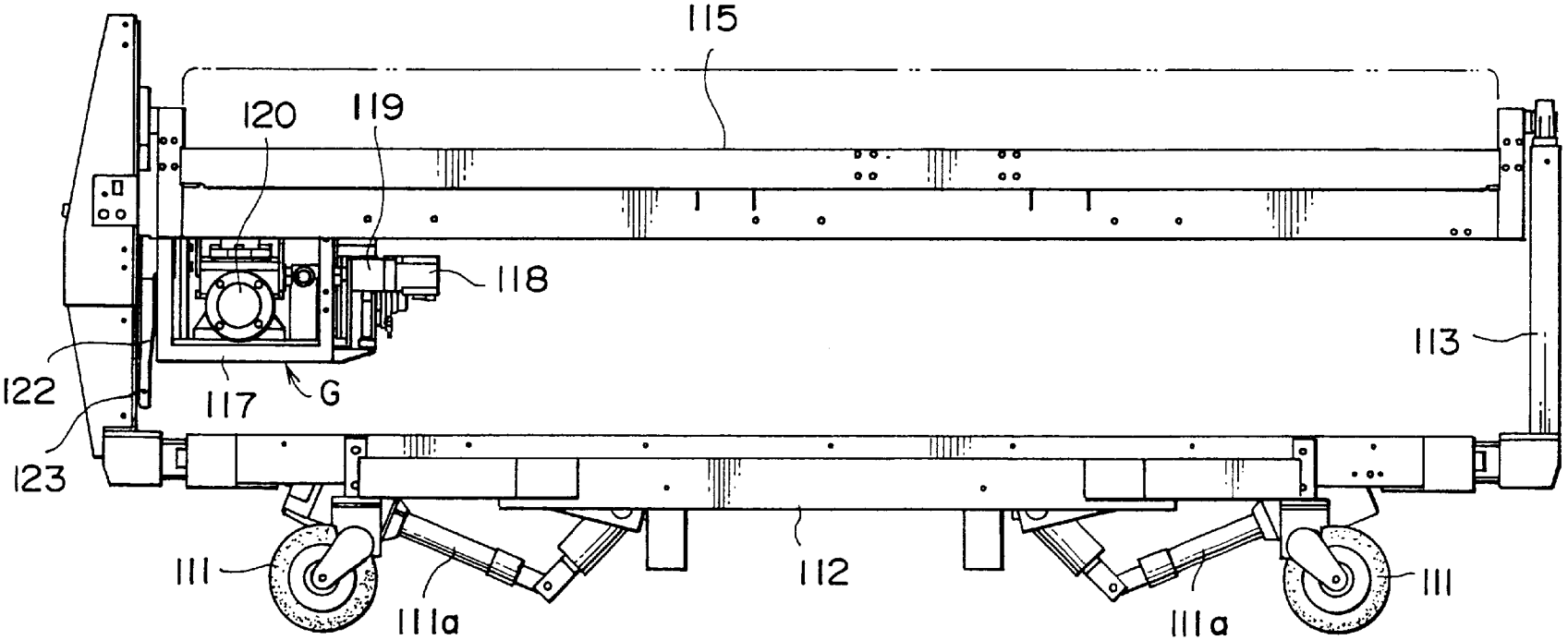
FIG. 2 is a side view taken along a line A—A of the bed shown in FIG. 1.
Figure 3:
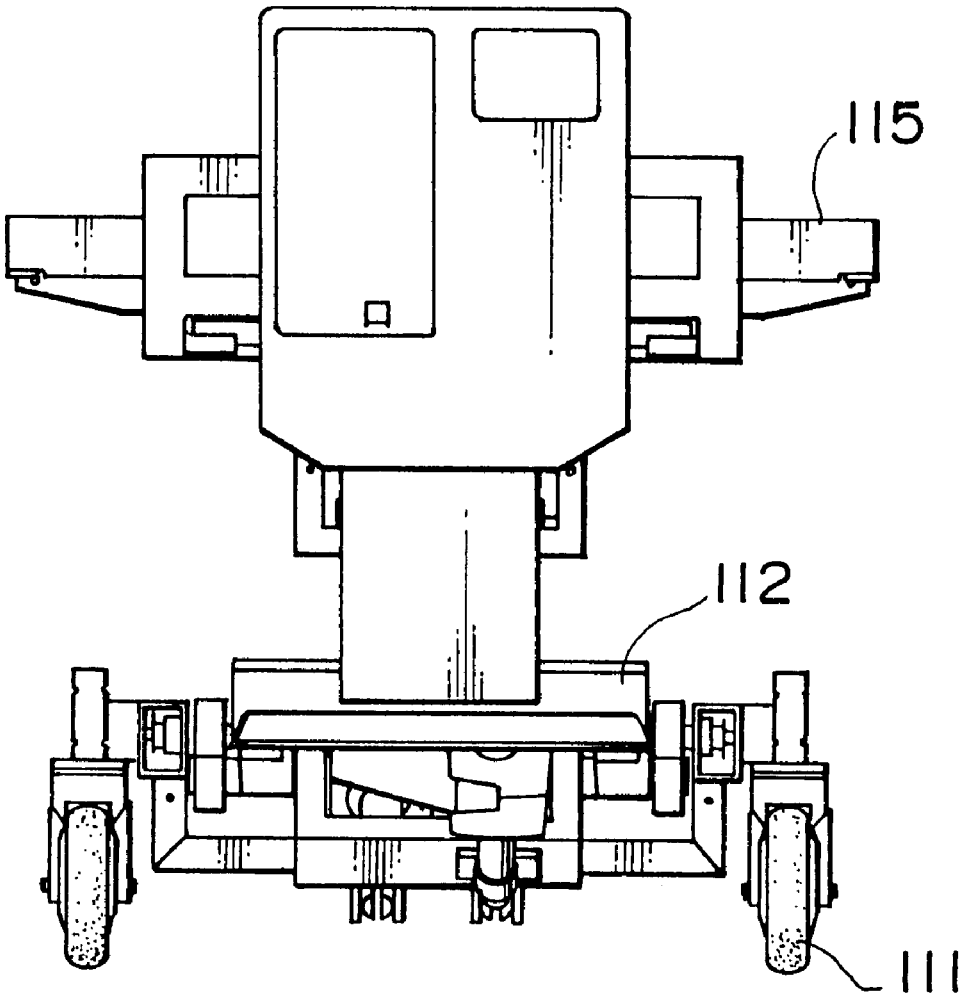
FIG. 3 is a front view taken along a line B—B of the bed shown in FIG. 1.
Figure 4:
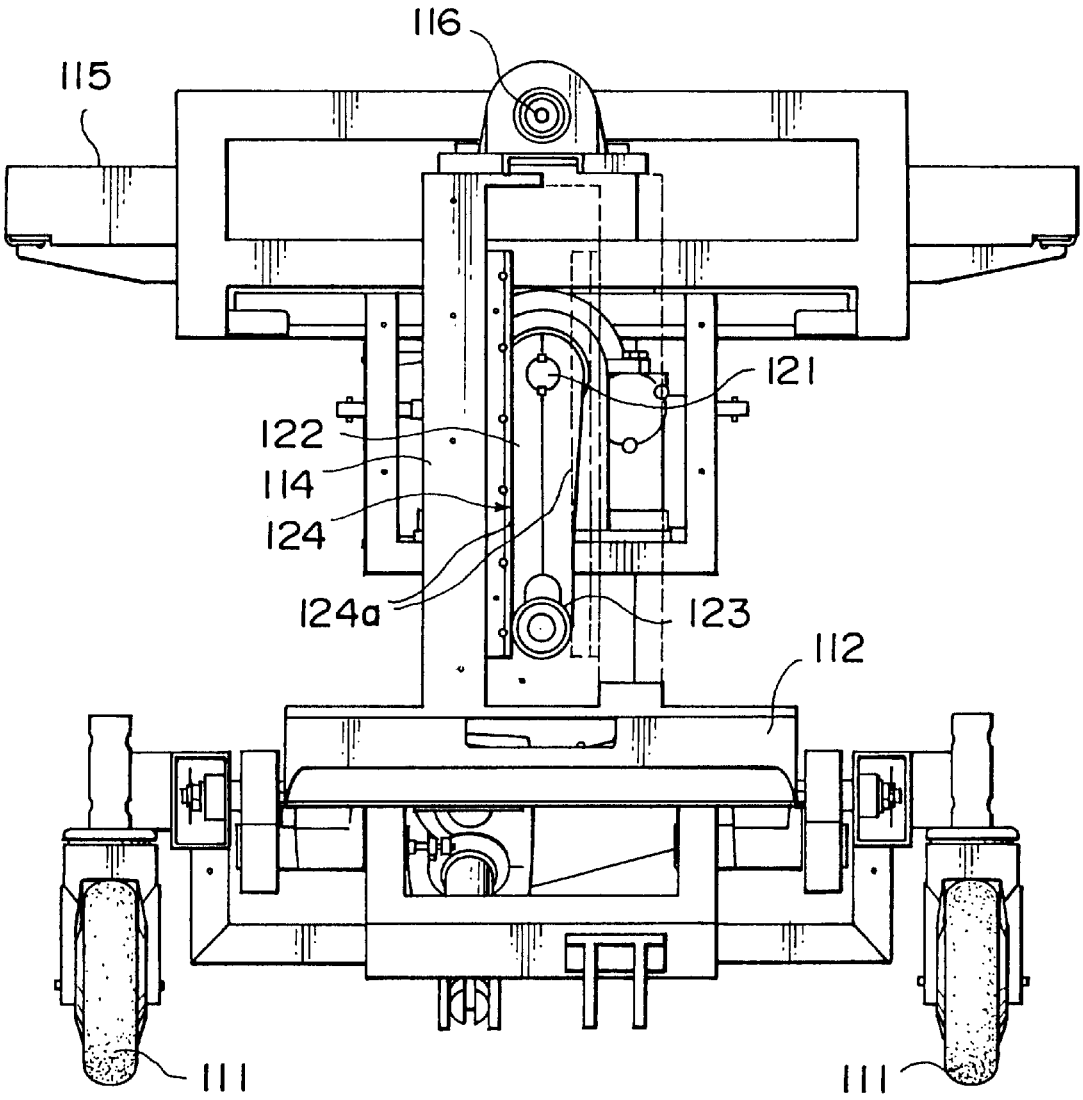
FIG. 4 is a front view showing the bed of FIG. 3 with a control section removed therefrom.
Figure 5:
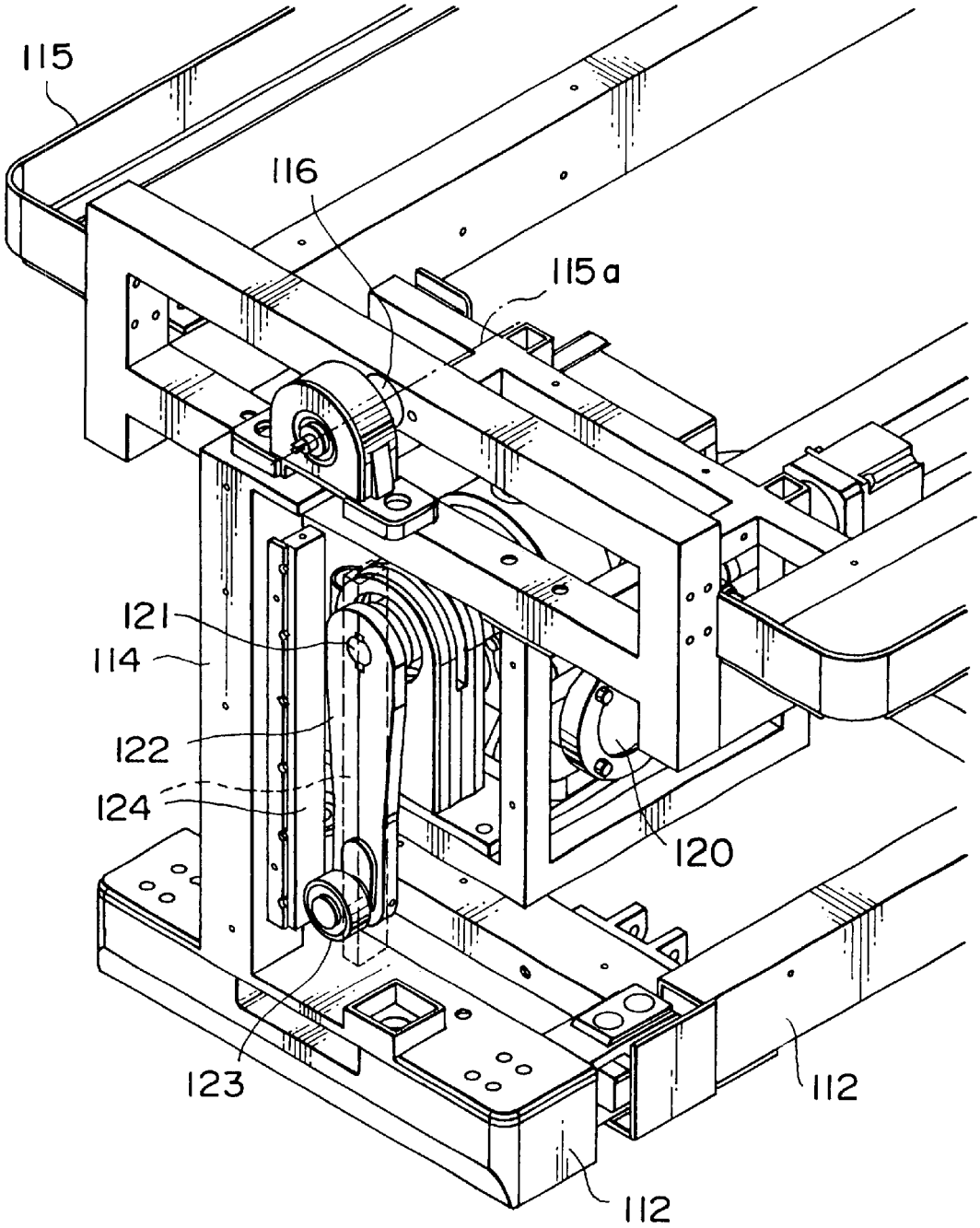
FIG. 5 is a perspective view of the bed shown in FIG. 4.

An embodiment of the present invention will now be described with reference to the drawings.

As shown in FIGS. 1 to 5 and FIG. 10, struts 113 and 114 erect at both end portions of a base frame 112 that is provided with wheels 111. A rest frame 115, on which a mattress is to be mounted, is supported on the upper end portions of the struts 113 and 114 so that it can tilt on either side about a pivot 116 (see FIG. 4). Note that the mattress on which a patient will lie down is removed from the rest frame 115 in these figures. Further, expanding cylinders 111*a* are provided in order to adjust the height of the bed by driving support members of the wheels 111, respectively.

A driving mechanism G for rocking the rest frame 115 (see FIGS. 2 and 10) comprises an electric motor 118 that is installed under the rest frame 115 through a support member 117, a planetary reduction gear 119 (whose reduction ratio is 1 to 10) serving as a first reduction gear coupled to a rotating shaft of the motor 118, and a worm reduction gear 120 (whose reduction ratio is 1 to 150) serving as a second reduction gear coupled to the reduction gear 119. Thus, both reduction gears provide a total reduction ratio of 1 to 1500.

An output shaft 121 of the worm reduction gear 120 projects in parallel with a rocking axis 115*a* (see FIG. 5) of the rest frame 115 below the same axis 115*a*, and has an arm 122 provided on a distal end thereof. The arm 122 is firmly secured to the distal end of the output shaft 121 on an upper end portion thereof at right angles to the shaft 121, and thus the arm 122 is suspended vertically when the rest frame 115 is held in a horizontal position.

The arm 122 also has an independent roller 123 on a lower end portion thereof The roller 123, which functions as a guided member, can be guided only vertically by a vertical guide member 124 that is arranged on the base frame 112. The guide member 124 comprises a pair of parallel guide surfaces 124*a* closely flanking the roller 123 on both sides of the roller 123. Note that the diameter of the roller 123 is 0.2 mm smaller than the distance between the pair of guide surfaces 124*a*, whereby a very small gap is provided between the roller 123 and each surface 124*a* opposed thereto.

The driving mechanism G, which causes the rest frame 115 to rock right and left, has the above construction.

Figure 6:
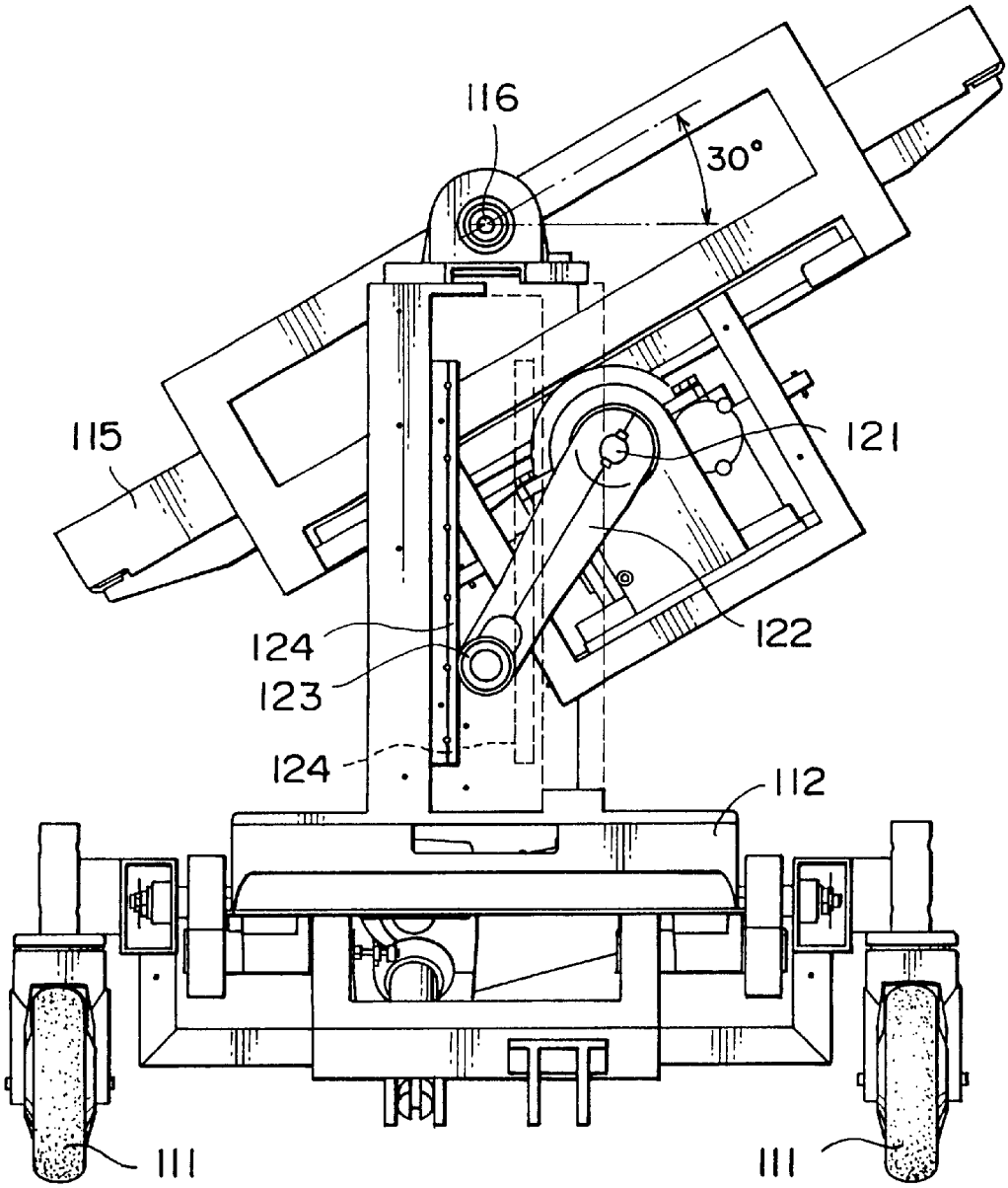
FIG. 6 is a front view of the bed shown in FIG. 4 which is inclined.
Figure 7:
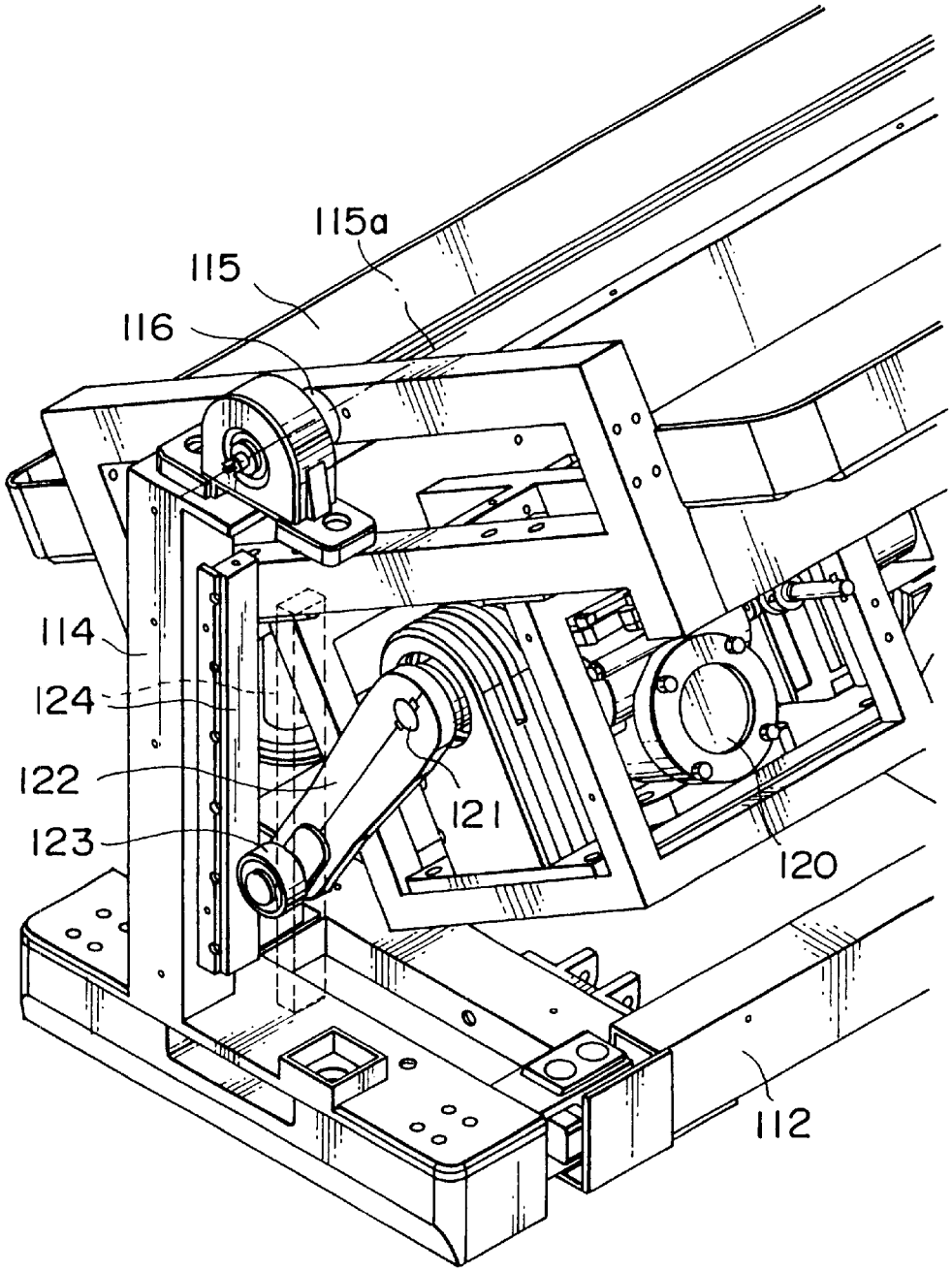
FIG. 7 is a perspective view showing the main part of the bed of FIG. 6.

More specifically, when the motor 118 mounted on the driving mechanism G rotates, the output shaft 121 whose speed is adequately reduced by the planetary reduction gear 119 and the worm reduction gear 120 starts rotating slowly together with the arm 122 that is firmly secured to the shaft 121 on its upper end. Then, as shown in FIGS. 6 and 7, the rest frame 115 tilts about the pivot 116 as the roller 123 provided on the lower end portion of the arm 122 climbs up along the vertical guide member 124 while guided by the member 124.

Figure 8:
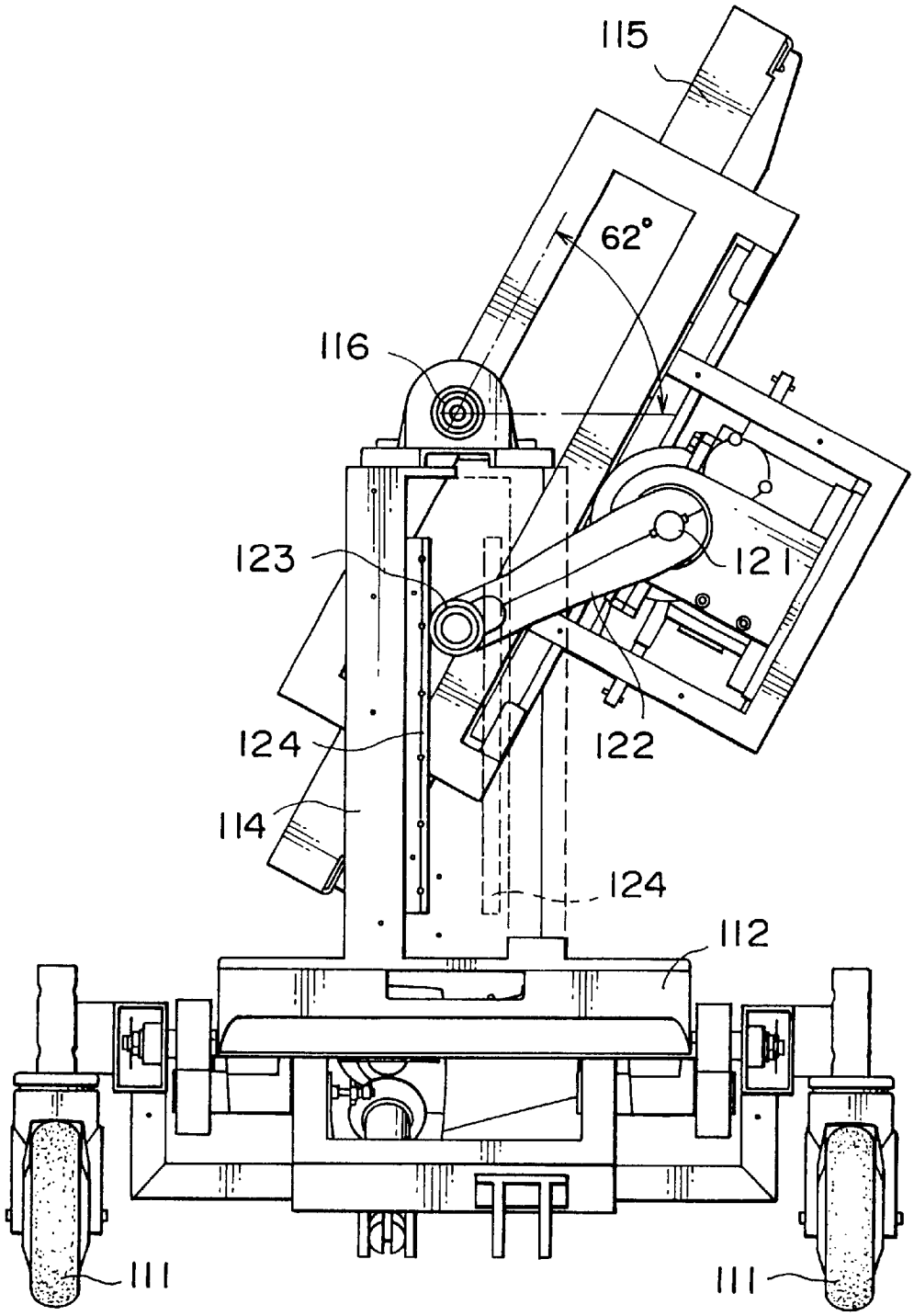
FIG. 8 is a front view of the bed of FIG. 6 which is further inclined to reach a maximum angle of inclination.
Figure 9:
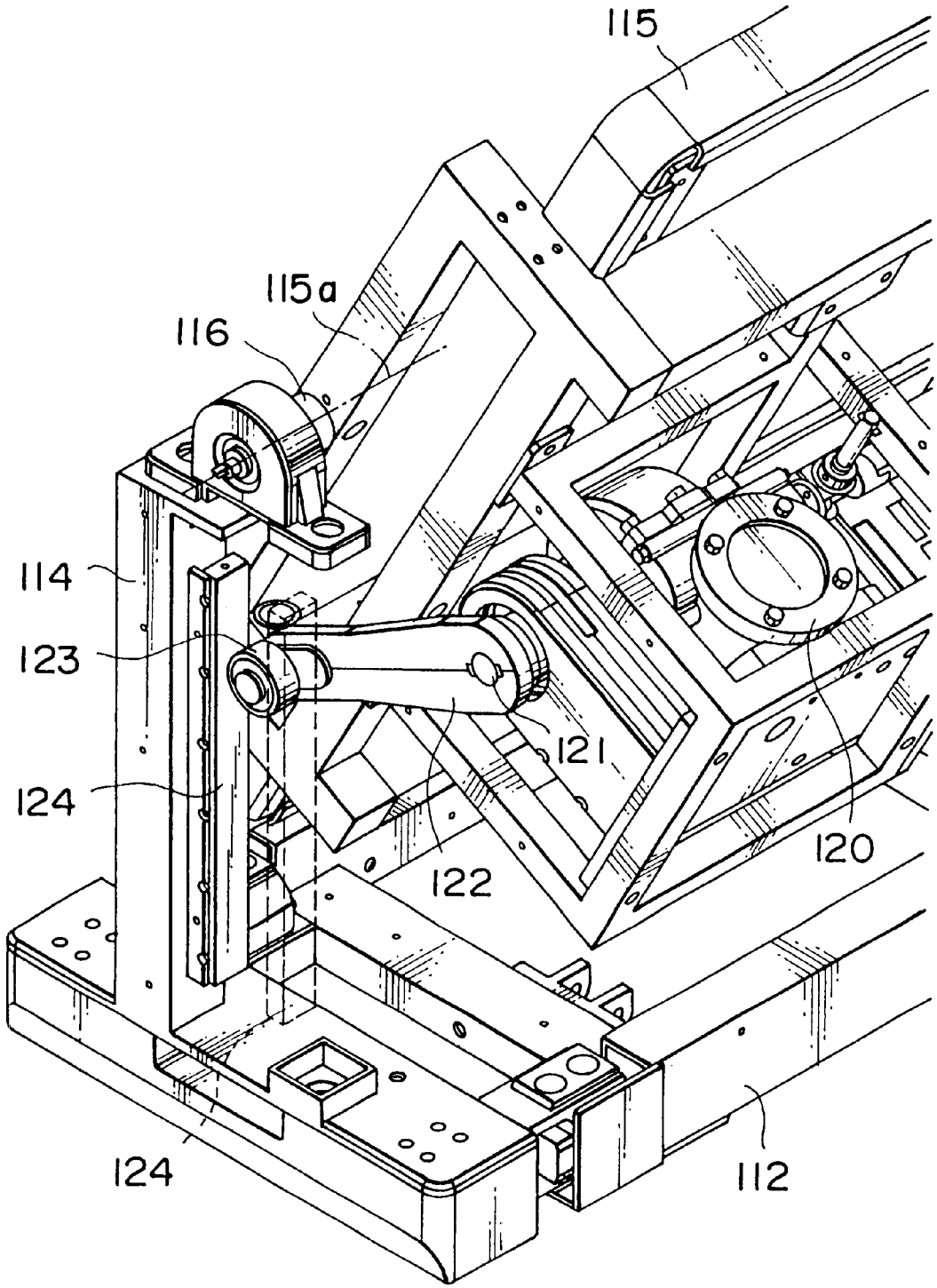
FIG. 9 is a perspective view showing the main part of the bed of FIG. 8.
Figure 10:
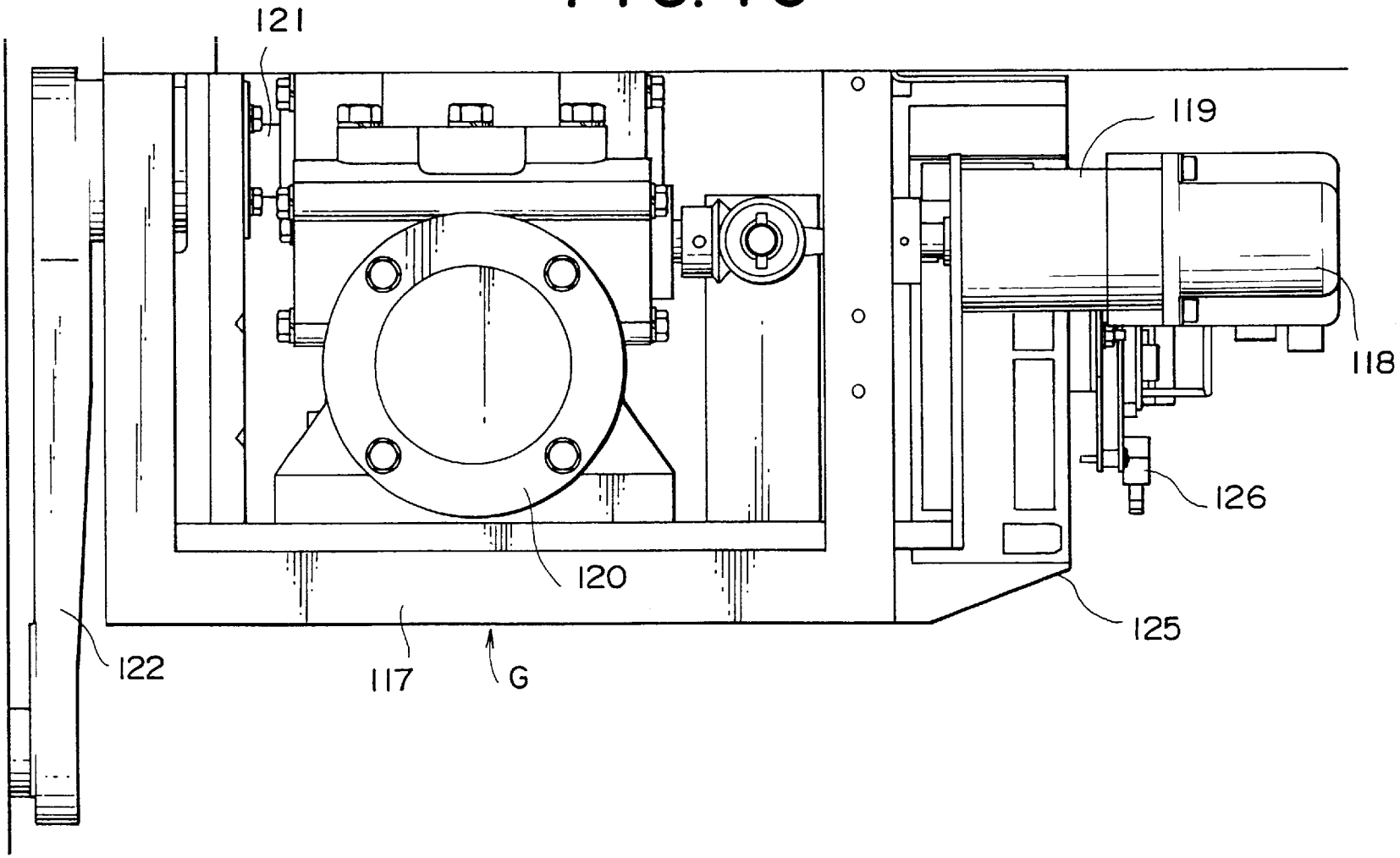
FIG. 10 is an enlarged side view of a driving mechanism for the bed shown in FIG. 2.
Figure 11:
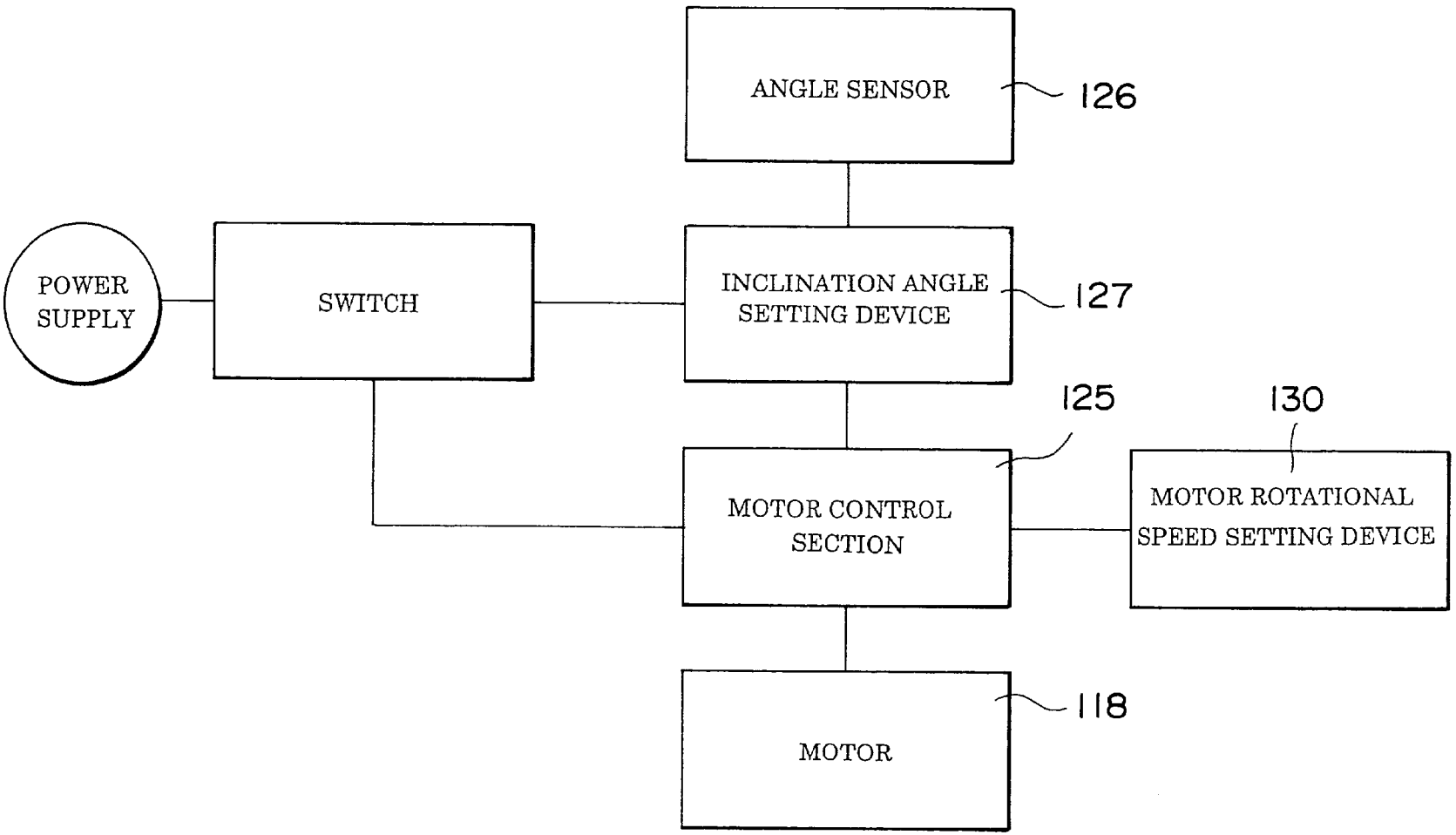
FIG. 11 is a block diagram showing a control system for the above bed.

Further, to rock the rest frame 115 right and left through the forward and reverse rotations of the output shaft 121, there is provided a motor control section 125 (see FIG. 11) for rotating the motor 118 forwardly and reversely. The motor control section 125 has a selector switch that causes the motor 118 to invert its rotation when the rest frame 115 reaches a maximum angle of inclination (e.g., 62 degrees; see FIGS. 8 and 9) based on a detected signal from an angle sensor 126 that detects an angle at which the rest frame 115 is inclined with respect to its horizontal position.

Further, an inclination angle setting device 127 that adjusts the maximum angle of inclination of the rest frame 115 to a desired angle is connected to the motor control section 125, so that a detected signal from the angle sensor 126 is applied to the motor control section 125 via the inclination angle setting device 127 in this embodiment.

Further, a motor rotational speed setting device 130 (see FIG. 11) that adjusts the cycle of rocking the rest frame 115 right and left (partial rotation) is also connected to the motor control section 125, and applies a rotational speed setting signal to the control section 125.

In the rocking bed according to the above-mentioned embodiment, as the output shaft 121 of the reduction gears 119 and 120 coupled to the rotating shaft of the motor 118 gently rotates in the driving mechanism G that is installed under the rest frame 115 for mounting a mattress thereon, the arm 122 that is firmly secured to the distal end of the output shaft 121 on its upper end portion at right angles to the shaft 121 begins to turn, so that the roller 123 on the lower end portion of the arm 122 serving as the guided member abuts the vertical guide member 124 and thereby receives a reaction force therefrom. This, in turn, causes the arm 122 to gently swing sideward, allowing the roller 123 to climb up along the vertical guide member 124. As the roller 123 moves up, the rest frame 115 gets inclined quietly, increasing its angle of inclination.

Then, when the motor control section 125 controls the motor 118 to invert its rotation, the rest frame 115 starts rocking right and left.

Further, the guided member provided on the lower end portion of the arm 122 is the roller 123 that is an independent member rotatably supported on such end portion of the arm 122, and the vertical guide member 124 having the pair of guide surfaces closely flanking the roller 123 on both sides of the roller 123 is also provided. As a result of this construction, the lower end portion of the arm 122 can move up and down extremely smoothly, thereby allowing the rest frame 115 for mounting a mattress thereon to rock on either side smoothly as well as quietly.

Moreover, the control section of the motor 118 includes the selector switch that inverts the rotation of the motor 118 when the rest frame 115 reaches a present maximum angle of inclination based on a detected signal from the angle sensor 126 that detects the angle at which the rest frame 115 is inclined. Therefore, the motor is appropriately controlled to rotate both forwardly and reversely at all times, thereby preventing excessive inclination of the rest frame 115.

Furthermore, the inclination angle setting device 127, which applies an inclination angle setting signal for adjusting the maximum angle of inclination of the rest frame 115 to a desired one, is connected to the control section of the motor 118. Therefore, the maximum angle of inclination of the rest frame 115 can be properly set in accordance with the condition of a patient who is lying on the bed, and can even set to a maximum angle of inclination, which is around 60 degrees, after checking that the patient is safely held on the bed.

Further, when the motor rotational speed setting device 130 for adjusting the cycle of rocking the rest frame 115 right and left is connected to the motor control section 125, the rocking cycle of the rest frame 115 can be changed so easily and smoothly that not only the maximum angle of inclination of the rest frame 115 can be adjusted properly but also the posture of the patient can be changed optimally.

Figure 12:
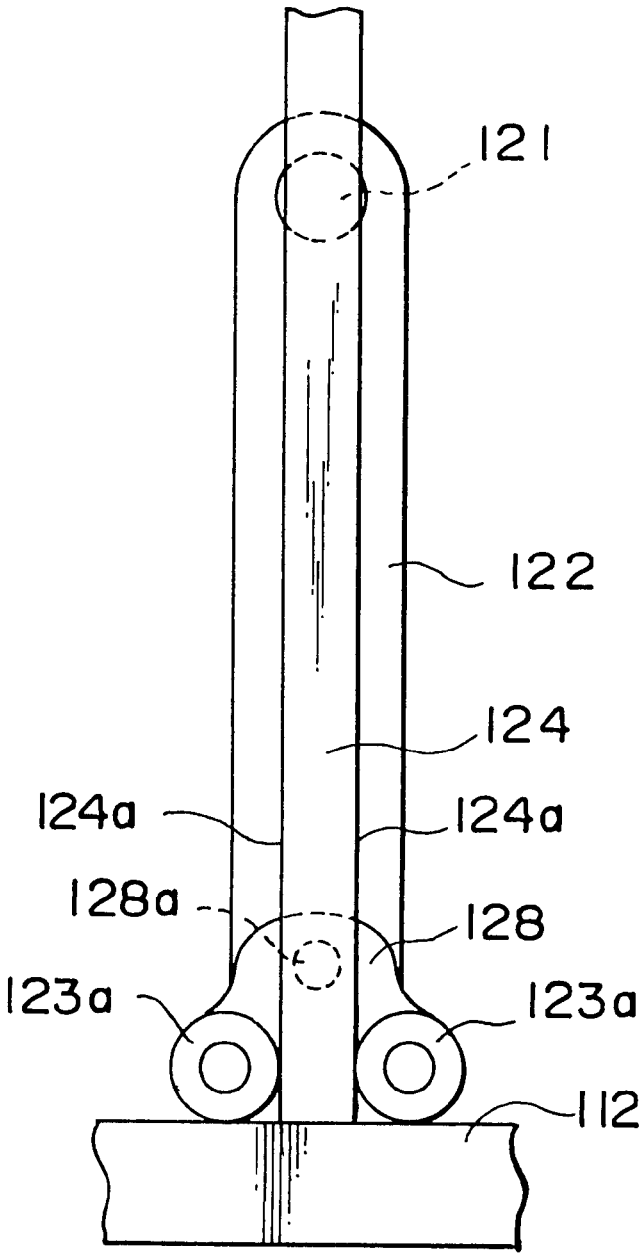
FIG. 12 is a front view showing a modified example of the driving mechanism for the above rocking bed.
Figure 13:
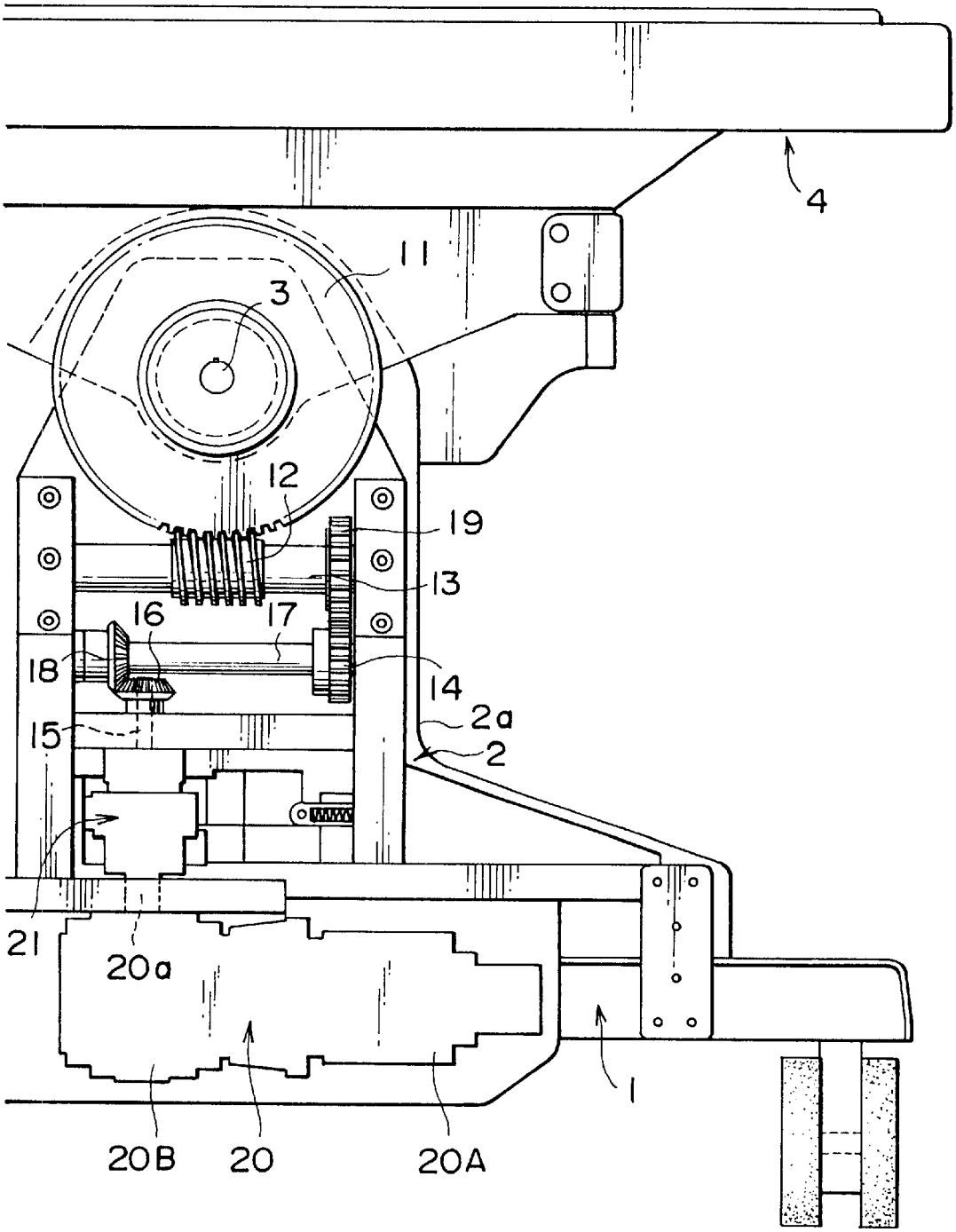
FIG. 13 is a front view showing the main part of a conventional rocking bed.

Note that one may adopt a modified example shown in FIG. 12, which is a guided member that is arranged on the lower end portion of the arm 122.

That is, the guided member attached to the lower end portion of the arm 122 that is firmly secured to the output shaft 121 on its upper end portion may be comprised of a roller support member 128 rotatably supported on the lower end portion of the arm 122 through a pivot 128*a*, and a pair of rollers 123*a* and 123*a* rotatably supported on the roller support member 128. A guide bar 124, which functions as a vertically extending vertical guide member while clamped between these rollers 123*a* and 123*a*, may be erected on the base frame 112.

In the construction in which the guided member on the lower end portion of the arm 122 includes the roller support member 128 rotatably supported on the lower end portion of the arm 122 and the pair of rollers 123*a* rotatably supported on the roller support member 128 and in which the guide bar 124 as the vertical guide member is clamped between these rollers 123*a*, the lower end portion of the arm 122 is allowed to move up and down also extremely smoothly. In addition, during such movement of the arm 122, the pair of rollers 123*a* can move up and down while rotating in directions opposite to each other, and this allows the rollers 123*a* to operate properly in touch with the guide bar 124 without having clearance with the guide bar 124 at all times, and hence the rest frame 115 can rock right and left further smoothly and quietly.

As described in detail in the foregoing, the rocking bed of the present invention can provide the following advantages.

(1) As the output shaft connected to the reduction gears coupled to the rotating shaft of the motor rotates gently in the driving mechanism that is installed under the rest frame for mounting a mattress thereon, the arm firmly secured to the distal end of the output shaft on its upper end at right angles to the output shaft begins to turn, thereby causing the guided member on the lower end portion of the arm to receive a reaction force derived from its abutment with the vertical guide member, and this further causes the arm to gently swing sideward, hence allowing the rest frame to quietly incline while increasing its angle of inclination through the vertical movement of the guided member along the vertical guide member. Then, as the motor control section effects control over the motor so that the motor inverts its rotation, the rest frame begins to rock right and left properly. Thus, as a result of this construction, the motor can be downsized and noise can be reduced, and further the structure of the rocking bed can be remarkably simplified compared with the conventional all gear drive bed.

(2) When the guided member on the lower end portion of the arm is formed into the independent roller rotatably supported on the lower end of the arm, and when the vertical guide member having the pair of guide surfaces closely flanking the roller on both sides of the roller is provided, the lower end portion of the arm can move up and down extremely smoothly, thereby allowing the rest frame for mounting a mattress thereon to rock on either side smoothly as well as quietly.

(3) When the guided member on the lower end portion of the arm includes the roller support member rotatably supported on the lower end portion of the arm and the pair of rollers rotatably supported on the roller support member, and when the guide bar functioning as the vertical guide member is arranged to be clamped between these rollers, the lower end portion of the arm moves up and down extremely smoothly. In addition, during such movement, the pair of rollers can move up and down while rotating in directions opposite to each other, so that the rollers operate properly in touch with the guide bar without clearance at all times. Thus, the rest frame can rock right and left further smoothly and quietly.

(4) When the control section of the motor includes the selector switch for inverting the rotation of the motor at the time the rest frame reaches a preset maximum angle of inclination based on a detected signal from the angle sensor that detects the angle at which the rest frame is inclined, the forward and reverse driving of the motor can be controlled properly at all times, hence preventing excessive inclination of the rest frame.

(5) When the inclination angle setting device that applies an inclination angle setting signal for adjusting the maximum angle of inclination of the rest frame to a desired angle of inclination is connected to the control section of the motor, the maximum angle of inclination of the rest frame can be set properly in accordance with the condition of a patient who is lying on the bed, and a maximum angle of inclination of around 60 degrees can even be set, if necessary, after checking that the patient is safely supported on the bed.

(6) When the motor rotational speed setting device for adjusting the cycle of rocking the rest frame right and left is connected to the motor control section, the rocking cycle of the rest frame can be changed easily and smoothly, thereby optimally adjusting the maximum angle of inclination of the rest frame and properly changing the position of a patient.

What is claimed is:

1. A rocking bed comprising:

a base frame;

struts respectively erected at both end portions of said base frame;

a rest frame for mounting a mattress thereon, which is supported on upper end portions of said struts in a manner rockable right and left; and a driving mechanism for rocking said rest frame;

wherein said driving mechanism comprises:

a motor installed under said rest frame;

a reduction gear coupled to a rotating shaft of said motor;

an output shaft projecting from said reduction gear in parallel with a rocking axis of said rest frame below said rocking axis;

an arm having an upper end portion thereof secured to a distal end of said output shaft to be vertically suspended when said rest frame is in a horizontal position;

a vertical guide member provided on said base frame for guiding a guided member provided on a lower end portion of said arm only vertically; and a motor control section for rotating said motor forwardly and reversely so that forward and reverse rotations of said output shaft allow said rest frame to rock right and left.

2. A rocking bed according to claim 1, wherein said guided member on said lower end portion of said arm is constructed of an independent roller rotatably supported on said lower end portion of said arm, and said vertical guide member is provided with a pair of guide surfaces for guiding said roller vertically, said guide surfaces closely flanking said roller on both sides of said roller.

3. A rocking bed according to claim 1, wherein said guided member on said lower end portion of said arm comprises a roller support member rotatably supported on said lower end portion of said arm and a pair of rollers rotatably supported on said roller support member, and said vertical guide member is constructed as a vertically extending guide bar which is clamped between said pair of rollers.

4. A rocking bed according to claim 1, wherein said motor control section comprises a selector switch for inverting the rotation of said motor when said rest frame reaches a preset maximum angle of inclination on the basis of a detected signal from an angle sensor for detecting an angle at which said rest frame is inclined.

5. A rocking bed according to claim 4, wherein an inclination angle setting device for adjusting a maximum angle of inclination of said rest frame to a desired angle of inclination is connected to said motor control section.

6. A rocking bed according to claim 5, wherein a motor rotating speed setting device for adjusting a cycle for rocking said rest frame right and left is connected to said motor control section.

* * * * *